US005927250A

United States Patent [19]

Nishida

[11] Patent Number: 5,927,250

[45] Date of Patent: Jul. 27, 1999

[54] CAR THROTTLE CONTROLLER

[75] Inventor: Shinichi Nishida, Hyogo-ken, Japan

[73] Assignee: Mitsubishi Denki Kabushiki Kaisha, Tokyo, Japan

[21] Appl. No.: 08/990,784

[22] Filed: Dec. 15, 1997

[30] Foreign Application Priority Data

May 19, 1997 [JP] Japan ..... 9-128917

[51] Int. Cl.[6] ..... F02D 11/10

[52] U.S. Cl. ..... 123/399; 123/396

[58] Field of Search ..... 123/396, 399

[56] References Cited

U.S. PATENT DOCUMENTS

| | | | |
|---|---|---|---|
| 4,779,597 | 10/1988 | Takaku et al. | 123/479 |
| 5,092,298 | 3/1992 | Suzuki et al. | 123/399 |
| 5,492,097 | 2/1996 | Byram et al. | 123/399 |

FOREIGN PATENT DOCUMENTS 3-141841 6/1991 Japan .

*Primary Examiner*—Erick R. Solis
*Attorney, Agent, or Firm*—Sughrue, Mion, Zinn, Macpeak & Seas, PLLC

[57] ABSTRACT

When fully closed valve judging means judges that the detected throttle opening is equal to or smaller than a full close criterion value, valve moving amount judging means judges that a change in detected throttle opening per a predetermined time is equal to or smaller than a movement criterion value, and opening difference judging means judges that the difference between the detected throttle valve and the target throttle opening is equal to or larger than a difference criterion value, a car throttle controller considers that the throttle valve is fixed at a fully closed position and outputs a malfunction signal.

7 Claims, 6 Drawing Sheets

CAR THROTTLE CONTROLLER

BACKGROUND OF THE INVENTION

1. [Field of the Invention]

This invention relates to an apparatus for controlling the opening of a throttle valve for adjusting the volume of intake air for the engine of an automobile.

2. [Description of the Prior Art]

FIG. 6 shows a throttle controller disclosed by Laid- open Japanese Patent Application No. Hei 3-141841. In FIG. 6, reference numeral 1 denotes an accelerator which turns in a direction shown by an arrow W from an initial position shown by a solid line by an unshown force in the direction shown by the arrow W, turns in a direction opposite to the direction shown by the arrow W by an unshown spring force when the force in the direction shown by the arrow W decreases and returns to the original position by the spring force when the force is removed. Numeral 2 represents an accelerator operation amount detection means which comprises a first accelerator sensor 2*a* and a second accelerator sensor 2*b*. The first and second accelerator sensors 2*a* and 2*b* output individual signals corresponding to the operation amount of the accelerator 1 from the initial position of the accelerator 1 to a control unit 12 incorporating a microcomputer. Numeral 3 denotes an accelerator switch for detecting whether the accelerator is in operation, which is turned on to output an ON signal to the control unit 12 when the accelerator 1 is away from its initial position and is turned off to output an OFF signal to the control unit 12 when the accelerator 1 is located at its initial position. Numeral 4 is an engine mounted on an automobile, 5 an engine speed sensor which outputs a signal corresponding to an engine speed to the control unit 12, 6 a car speed sensor mounted on the automobile which outputs a signal corresponding to the driving speed of the automobile to the control unit 12, and 7 a suction pipe which introduces air purified by an unshown air filter to the engine 4. Numeral 8 represents a throttle valve incorporated in the suction pipe 7 at a predetermined position, which turns around a valve axis 8*a* from a fully closed position shown by a solid line at which the volume of intake air is reduced to an extent that an engine stall occurs toward a fully opened position shown by a dotted line at which the volume of intake air is maximal or turns from the fully opened position toward the fully closed position to adjust the volume of intake air for the engine 4. Numeral 9 represents a throttle actuator, provided external to the suction pipe 7, for driving the throttle valve 8 to open at a rotation angle based on the fully closed position in response to a signal output from the control unit 12, and 10 a throttle opening sensor, provided external to the suction pipe 7, for detecting the opening of the throttle valve 8 and outputting a signal corresponding to the detected opening to the control unit 12. Reference numeral 11 represents a main switch mounted on the automobile, which starts an unshown starter motor mounted on the automobile by supplying power from an unshown battery to start driving the engine 4 when an unshown key plate is inserted into a key hole 11*a* and turned from an off position 11*b* to an IG position 11*d* through an AAC position 11*c* to turn on an ignition switch at the IG position 11*d*. The control unit 12 comprises a throttle opening control means 13, which is activated with power supplied from the battery when the key plate inserted into the key hole 11*a* of the main switch 11 reaches the ACC position 11*c*, to control the opening of the throttle valve 8 electrically in accordance with a program prestored in an unshown memory incorporated in the control unit 12. The control unit 12 further comprises a valve fixation diagnosis means 23 which determines electrically whether the throttle valve 8 is fixed at a fully closed position in accordance with the program prestored in the memory.

A description is subsequently given of the operation of the car throttle controller of FIG. 6. When the starter motor is started by inserting the key plate into the key hole 11*a* of the main switch 11 without operation of the accelerator 1, the throttle opening control means 13 opens the throttle valve 8 to a position where the volume of air required for the start of the engine 4 is supplied to the engine 4 from its fully closed position through the throttle actuator 9 based on a calculated target throttle opening. When the driver steps on the accelerator 1 after the engine 4 is started, the first and second accelerator sensors 2*a* and 2*b* output individual signals corresponding to the operation amount of the accelerator 1 to the control unit 12. The throttle opening control means 13 calculates an average value of the operation amounts of the accelerator 1 from the first and second accelerator sensors 2*a* and 2*b*, calculates a target throttle opening by inserting into an operation expression preset in the throttle opening control means 13 such data as the calculated average value, an engine speed from the engine speed sensor 5, a car speed from the car speed sensor 6 and the amount of an electrical load on the battery, and outputs an opening control signal for nullifying the difference between the target throttle opening and the throttle opening detected by the throttle opening sensor 10 to the throttle actuator 9. Thereby, the throttle actuator 9 is supplied with power corresponding to the opening control signal from the battery to control the opening of the throttle valve 8 to the target throttle opening. Thus, the intention of the driver is transmitted to the throttle opening control means 13 by the first and second accelerator sensors 2*a* and 2*b* through the operation amount of the accelerator 1 and the opening of the throttle valve 8 is electrically controlled to the target throttle opening by the throttle actuator 9 to adjust the output of the engine 4. When a voltage detection value representing a detected throttle opening from the throttle opening sensor 8 falls below a voltage decision value corresponding to the fully closed position of the throttle valve 8 preset in the valve fixation diagnosis means while the accelerator switch 3 is on, the valve fixation diagnosis means 23 concludes that the throttle valve 8 is fixed at a fully closed position. Then, according to the result of this judgment, the valve fixation diagnosis means 23 causes unshown spring force to be applied to the throttle valve 8 to return it to a neutral opening position.

The throttle controller of the prior art has the disadvantage that the throttle valve is determined to be fixed at the fully closed position when the target throttle opening is small and the opening of the throttle valve 8 is controlled to a position close to the fully closed position. That is concluded that the throttle valve is fixed at the fully closed position even though it is under control. This is because it is determined that the throttle valve 8 is fixed at a fully closed position based on one judging condition that a voltage detection value indicative of the detected throttle opening falls below a voltage decision value.

SUMMARY OF THE INVENTION

It is an object of the present invention to provide a car throttle controller which improves the detection accuracy of the throttle valve being fixed at a fully closed position based on a plurality of judging conditions. It is another object of the present invention to provide a car throttle controller which can continue emergency driving by determining that the throttle valve is fixed at a fully closed position. It is still another object of the present invention to provide a car throttle controller which informs a driver of the determination that the throttle valve is fixed at a fully closed position.

According to a first aspect of the present invention, a car throttle controller is provided which comprises: a throttle opening control means for adjusting the volume of intake air for an engine by controlling electrically the opening of a throttle valve to a target throttle opening based on a difference between the target throttle opening, calculated from data including the operation amount of an accelerator, and a throttle opening detected by throttle valve opening detection means for detecting the opening of the throttle valve; and a valve fixation diagnosis means for determining electrically whether the throttle valve is fixed at a fully closed position at which the volume of intake air for the engine is reduced to such an extent that an engine stall occurs, wherein the valve fixation diagnosis means comprises:

a fully closed valve judging means for determining whether the detected throttle opening is equal to or smaller than a fully closed criterion value;

a valve moving amount detection means for determining whether a change in a detected throttle opening per a predetermined time is equal to or smaller than a movement criterion value;

an opening difference judging means for determining whether a difference between the detected throttle opening and the target throttle opening is equal to or larger than a difference criterion value; and a valve malfunction detection means for concluding that the throttle valve is fixed at a fully closed position and outputting a malfunction signal when the fully closed valve judging means determines that the detected throttle opening is equal to or smaller than the fully closed criterion value, the valve moving amount judging means determines that a change in a detected throttle opening per a predetermined time is equal to or smaller than the movement criterion value, and the opening difference judging means determines that the difference between the detected throttle opening and the target throttle opening is equal to or larger than the difference criterion value.

According to a second aspect of the present invention, a car throttle controller is provided which comprises: a throttle opening control means for adjusting the volume of intake air for an engine by controlling electrically the opening of a throttle valve to a target throttle opening based on a difference between the target throttle opening, calculated from data including the operation amount of an accelerator, and a throttle opening detected by throttle valve opening detection means for detecting the opening of the throttle valve; and a valve fixation diagnosis means for determining electrically whether the throttle valve is fixed at a fully closed position at which the volume of intake air for the engine is reduced to such an extent that an engine stall occurs, wherein the valve fixation diagnosis means comprises:

a fully closed valve determining means for judging whether the detected throttle opening is equal to or smaller than a fully closed criterion value;

engine stable operation judging means for determining whether an engine speed is equal to or smaller than a stable operation criterion value;

an opening difference judging means for determining whether a difference between the detected throttle opening and the target throttle opening is equal to or larger than a difference criterion value; and a valve malfunction detection means for concluding that the throttle valve is fixed at a fully closed position and outputting a malfunction signal when the fully closed valve judging means determines that the detected throttle opening is equal to or smaller than the fully closed criterion value, the engine stable operation judging means determines that the engine speed is equal to or smaller than the stable operation criterion value, and the opening difference judging means determines that the difference between the detected throttle opening and the target throttle opening is equal to or larger than the difference criterion value.

According to a third aspect of the present invention, a car throttle controller is provided which comprises: a throttle opening control means for adjusting the volume of intake air for an engine by controlling electrically the opening of a throttle valve to a target throttle opening based on a difference between the target throttle opening, calculated from data including the operation amount of an accelerator, and a throttle opening detected by throttle valve opening detection means for detecting the opening of the throttle valve; and a valve fixation diagnosis means for determining electrically whether the throttle valve is fixed at a fully closed position at which the volume of intake air for the engine is reduced to such an extent that an engine stall occurs, wherein the valve fixation diagnosis means comprises:

a fully closed valve judging means for determining whether the detected throttle opening is equal to or smaller than a fully closed criterion value;

a valve moving amount detection means for determining whether a change in a detected throttle opening per a predetermined time is equal to or smaller than a movement criterion value;

an engine stable operation judging means for determining whether an engine speed is equal to or smaller than a stable operation criterion value;

an opening difference judging means for determining whether a difference between the detected throttle opening and the target throttle opening is equal to or larger than a difference criterion value; and a valve malfunction detection means for concluding that the throttle valve is fixed at a fully closed position and outputting a malfunction signal when the fully closed valve judging means determines that the detected throttle opening is equal to or smaller than the fully closed criterion value, the valve moving amount judging means determines that a change in a detected throttle opening per a predetermined time is equal to or smaller than the movement criterion value, the engine stable operation judging means determines that the engine speed is equal to or smaller than the stable operation criterion value, and the opening difference judging means determines that the difference between the detected throttle opening and the target throttle opening is equal to or larger than the difference criterion value.

According to a fourth aspect of the present invention, a car throttle controller is provided wherein a fully closed learned value which stores a throttle opening detected before the engine is started is used as the fully closed criterion value of any one of the first to third aspects.

According to a fifth aspect of the present invention, a car throttle controller is provided wherein the sum of a fully closed learned value which stores a throttle opening detected before the engine is started and a preset constant value is used as the fully closed criterion value of any one of the first to third aspects.

According to a sixth aspect of the present invention, a car throttle controller is provided wherein a bypass pipe, bypassing the throttle valve, for introducing air to the engine is provided in a suction pipe around the throttle valve of any one of the first to third aspects, and an emergency valve for closing the bypass pipe is provided in the bypass pipe and is opened in response to a malfunction signal from the valve malfunction detection means to open the bypass pipe.

According to a seventh aspect of the present invention, a car throttle controller is provided which further comprises a malfunction alarm means for informing a driver that the throttle valve is fixed at a fully closed position in response to a malfunction signal from the valve malfunction detection means of any one of the first to third aspect.

According to an eighth aspect of the present invention, a car throttle controller is provided which comprises: a throttle opening control means for adjusting the volume of intake air for an engine by controlling electrically the opening of a throttle valve to a target throttle opening based on a difference between the target throttle opening, calculated from data including the operation amount of an accelerator, and a throttle opening detected by throttle valve opening detection means for detecting the opening of the throttle valve; and a valve fixation diagnosis means for determining electrically whether the throttle valve is fixed at a fully closed position at which the volume of intake air for the engine is reduced to such an extent that an engine stall occurs, wherein a bypass pipe, bypassing the throttle valve, for introducing air to the engine is provided in a suction pipe around the throttle valve, and an emergency valve for closing the bypass pipe is provided in the bypass pipe and is opened to open the bypass pipe when the valve fixation diagnosis means judges that the throttle valve is fixed at a fully closed position.

According to a ninth aspect of the present invention, a car throttle controller is provided which comprises: a throttle opening control means for adjusting the volume of intake air for an engine by controlling electrically the opening of a throttle valve to a target throttle opening based on a difference between the target throttle opening, calculated from data including the operation amount of an accelerator, and a throttle opening detected by throttle valve opening detection means for detecting the opening of the throttle valve; and a valve fixation diagnosis means for determining electrically whether the throttle valve is fixed at a fully closed position at which the volume of intake air for the engine is reduced to such an extent that an engine stall occurs, wherein the controller further comprises a malfunction alarm means for informing a driver that the throttle valve is fixed at a fully closed position when the valve fixation diagnosis means judges that the throttle valve is fixed at the fully closed position.

The above and other objectives, features and advantages of the invention will become more apparent from the following description when taken in conjunction with the accompanying drawings.

DETAILED DESCRIPTION OF THE PREFERRED EMBODIMENTS

Preferred embodiments of the present invention are described herein with reference to the accompanying drawings wherein the same or corresponding elements as those of the prior art are given the same reference symbols.

Embodiment 1

Figure 1:
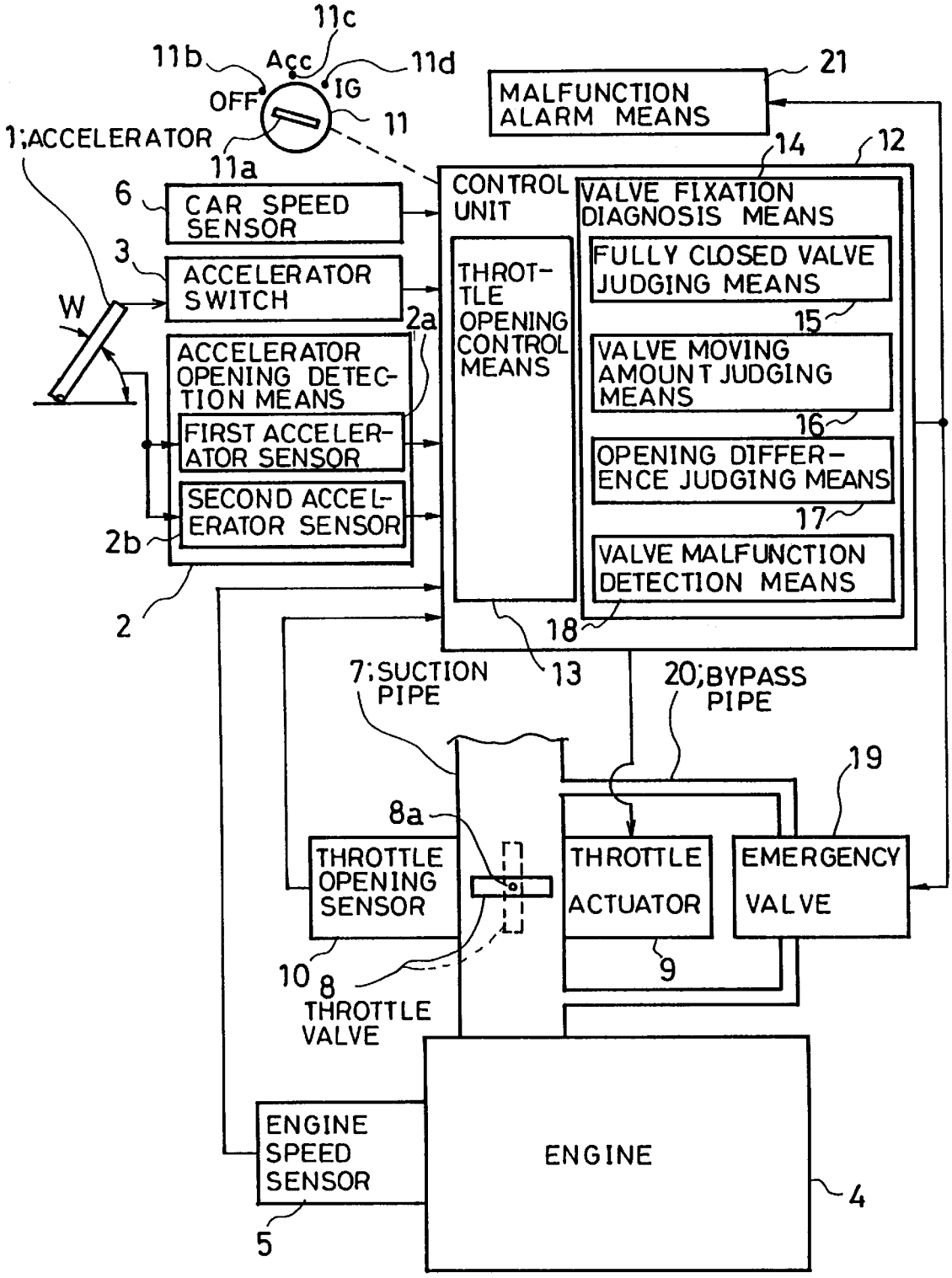
FIG. 1 is a structural diagram of Embodiment 1 of the present invention.
Figure 2:
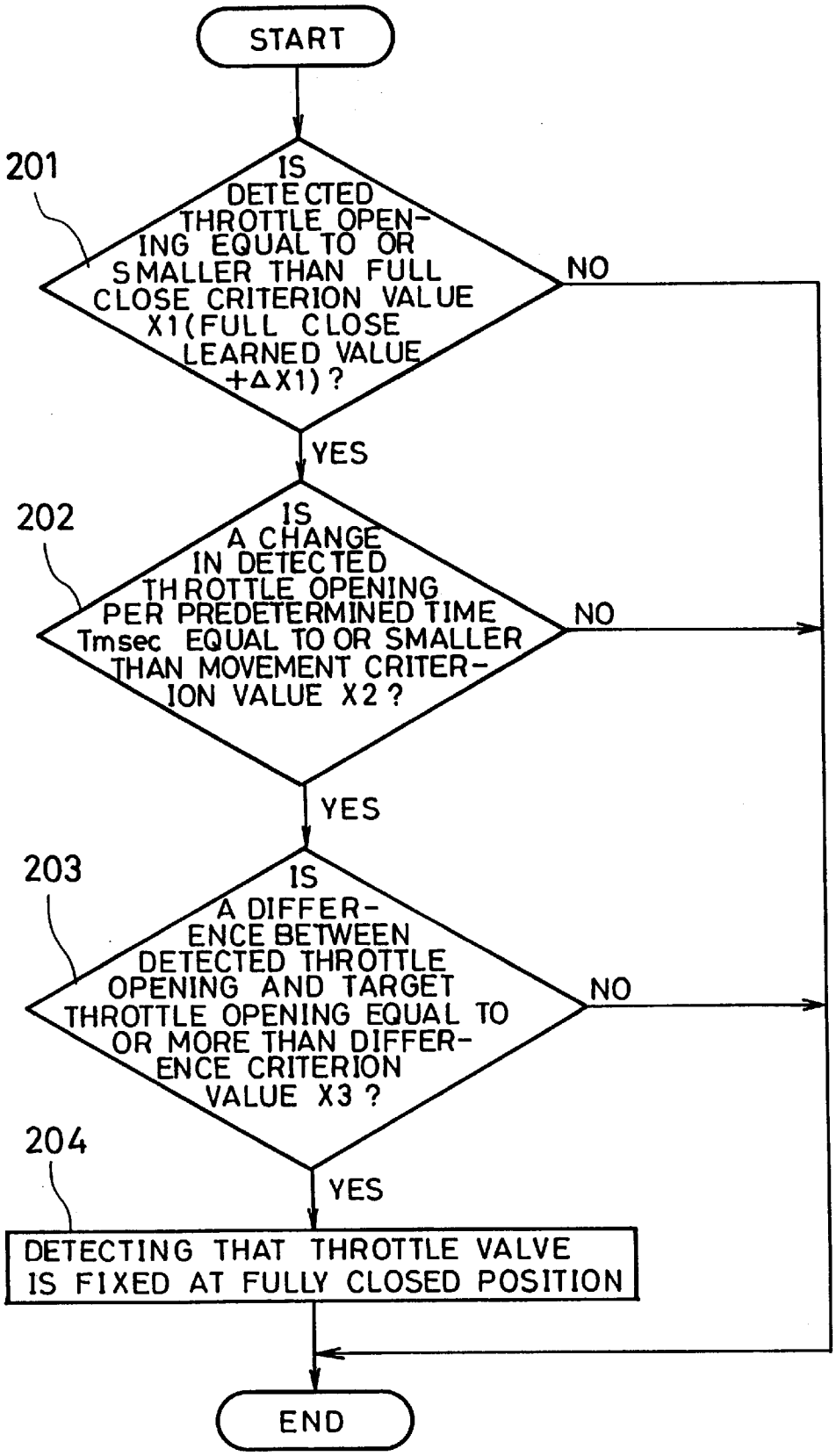
FIG. 2 is a flow chart illustrating the determination process on fixation in Embodiment 1 of the present invention.

FIG. 1 shows a throttle controller according to Embodiment 1 of the present invention and FIG. 2 is a flow chart illustrating the determination process on whether a throttle valve is fixed at a fully closed position in Embodiment 1.

In FIG. 1, when a driver inserts a key plate into a key hole 11*a* of a main switch 11 and a starter motor starts without the operation of an accelerator 1, a throttle opening control means 13 opens a throttle valve 8 to a position where the volume of air required for the start of an engine 4 can be supplied to the engine 4 from its fully opened position through a throttle actuator 9 based on a calculated target throttle opening. Then, when the driver steps on the accelerator 1 after the engine 4 is started, the first and second accelerator sensors 2*a* and 2*b* of an accelerator operation amount detection means 2 output signals corresponding to the operation amount of the accelerator 1 to the throttle opening control means 13 of a control unit 12. The throttle opening control means 13 calculates an average value of the operation amounts from the first and second accelerator sensors 2*a* and 2*b*, calculates a target throttle opening by inserting into an operation expression preset in the throttle opening control means 13 such data as the calculated average value, an engine speed from an engine speed sensor 5, a car speed from a car speed sensor 6 and the amount of an electrical load on a battery, and outputs an opening control signal for nullifying the difference between the target throttle opening and the throttle opening detected by a throttle opening sensor 10 to the throttle actuator 9. Thereby, the throttle actuator 9 is supplied with power corresponding to the opening control signal from the battery to control the opening of the throttle valve 8 to the target throttle opening to adjust the output of the engine 4.

In Embodiment 1, the valve fixation diagnosis means 14 of the control unit 12 comprises a fully closed valve judging means 15, a valve moving amount judging means 16, an opening difference judging means 17 and a valve malfunction detection means 18.

The fully closed valve judging means 15 determines whether the throttle valve 8 is located in the vicinity of a fully closed position by determining whether the detected throttle opening is equal to or smaller than a fully closed criterion value X1 which is a fully closed learned value plus ΔX1 stored in the fully closed valve judging means 15. That is, the fully closed valve judging means 15 concludes that the throttle valve 8 is located in the vicinity of the fully closed position if the detected throttle opening is equal to or smaller than the fully closed criterion value X1 and concludes that the throttle valve 8 is away from the fully closed position and close to a fully opened position if the detected throttle opening is larger than the fully closed criterion value X1. The fully closed learned value corresponds to a throttle opening detected before the engine 4 is started while the key plate reaches an ACC position 11*c* from an OFF position 11*b* of a main switch 11 and the control unit 12 is activated and receives an OFF signal from an accelerator switch 3 and is stored in the fully closed valve judging means 15 as the fully closed position of the throttle valve 8. ΔXi is a constant value preset in the fully closed valve judging means 15.

The valve moving amount judging means 16 determines whether the movement of the throttle valve 8 is small by determining whether a change in a detected throttle opening per a predetermined time Tmsec is equal to or smaller than a movement criterion value X2 preset in the valve moving amount judging means 16 as a constant value. That is, the valve moving amount judging means 16 determines that the movement of the throttle valve 8 is small if a change in a detected throttle opening per a predetermined time Tmsec is equal to or smaller than the movement criterion value X2 and concludes that the movement of the throttle valve 8 is large if a change in a detected throttle opening per a predetermined time Tmsec is larger than the movement criterion value X2.

The opening difference judging means 17 determines whether the difference between the target throttle opening and the detected throttle opening is large by determining whether the difference between the target throttle opening and the detected throttle opening is equal to or larger than a difference criterion value X3 preset in the opening difference judging means 17 as a constant value.

The valve malfunction detection means 18 concludes that the throttle valve 8 is fixed at the fully closed position and outputs a malfunction signal to an emergency valve 19 and malfunction alarm means 21 when the fully closed valve judging means 15 determines that the throttle valve 8 is located in the vicinity of the fully closed position, the valve moving amount judging means 16 determines that the movement of the throttle valve 8 is small, and the opening difference judging means 17 determines that the difference between the target throttle opening and the detected throttle opening is large.

The emergency valve 19 is provided in a bypass pipe 20 connected to a suction pipe 7 around the throttle valve 8 to guide clean air to a suction port of the engine 4 bypassing the throttle valve 8. The valve is closed to close the bypass pipe 20 while the throttle valve 8 is in normal operation and is opened to open the bypass pipe 20 in response to a malfunction signal from the valve malfunction detection means 18. That is, the emergency valve 19 is closed during the normal operation of the throttle valve 8 and is opened when the throttle valve 8 is fixed at a fully closed position, whereby clean air is sucked from the suction pipe 7 to the suction port of the engine 4 through the bypass pipe 20 bypassing the throttle valve 8.

The malfunction alarm means 21 is formed of one or more of a buzzer, lamp, indicator and speaker and informs a driver that the throttle valve 8 is fixed at the fully closed position by sound, light, voice or indication in response to a malfunction signal from the valve malfunction detection means 18.

According to Embodiment 1 of the present invention, the valve fixation diagnoses means 14 executes the flow chart of FIG. 2 to check if the throttle valve 8 is fixed at the fully closed position for each processing cycle of the microcomputer while the engine 4 is started by the operation of the key plate inserted into the key hole 11*a* of the main switch 11 and the opening of the throttle valve 8 is controlled by the throttle opening control means 13. That is, as shown in steps 201 to 203 of FIG. 2, when 1) the throttle valve 8 is located in the vicinity of the fully closed position, i.e., the detection throttle opening is equal to or smaller than the full close criterion value X1, 2) the movement of the throttle valve 8 is small, i.e., a change in detected throttle opening per a predetermined time Tmsec is equal to or smaller than the movement criterion value X2, and 3) the difference between the target throttle opening and the detected throttle opening is large, i.e., the difference between the target throttle opening and the detected throttle opening is equal to or larger than the difference criterion value X3, it is concluded in step 204 that the throttle valve 8 is fixed at the fully closed position, i.e., (the fixation of the throttle valve 8 at the fully closed position is detected).

In summary, in Embodiment 1, when three judging conditions are established: I)the throttle valve 8 is located in the vicinity of the fully closed position, 2) the movement of the throttle valve 8 is small, and 3) the opening of the throttle valve 8 is different from the target throttle opening, it is concluded that the throttle valve 8 is fixed at the fully closed position. Therefore, the detection accuracy of the throttle valve 8 being fixed at the fully closed position is improved as compared with the case where the throttle valve 8 being fixed at the fully closed position is determined based on only one judging condition that the detected throttle opening is equal to or smaller than a criterion value corresponding to the fully closed position of the throttle valve 8.

Since the valve malfunction detection means 18 opens the bypass pipe 20 by opening the emergency valve 19 when it detects that the throttle valve 8 is fixed at the fully closed position, clean air can be sucked from the suction pipe 7 to the suction port of the engine 4 through the bypass pipe 20 bypassing the throttle valve 8. Therefore, even if the throttle valve is fixed at the fully closed position, the occurrence of an engine stall is prevented and the automobile can be shifted from normal driving to emergency driving.

In addition, since the valve malfunction detection means 18 activates the malfunction alarm means 21 to inform a driver that the throttle valve 8 is fixed at the fully closed position, the driver can properly carry out a shift operation from normal driving to emergency driving.

Embodiment 2

Figure 3:
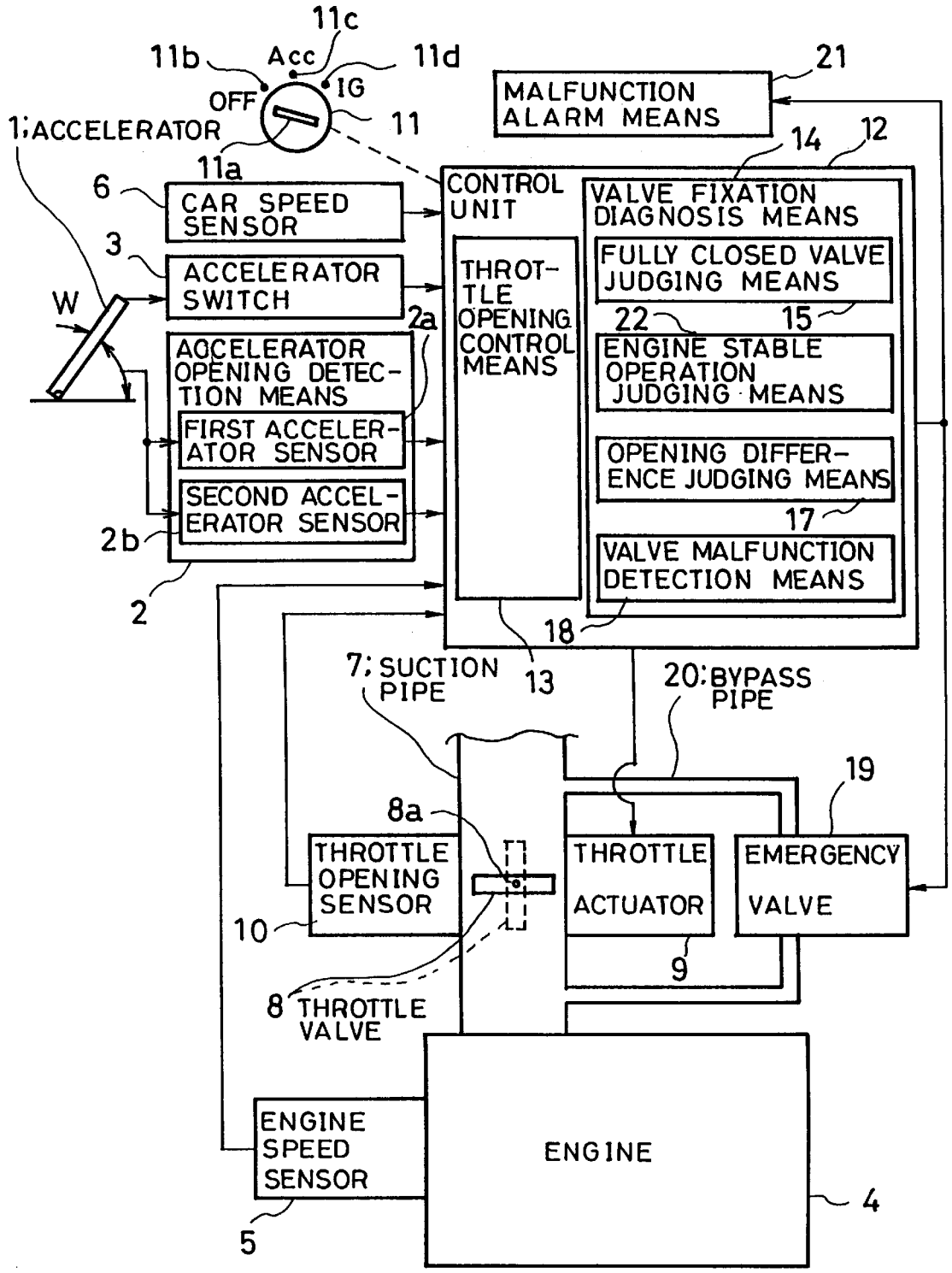
FIG. 3 is a structural diagram of Embodiment 2 of the present invention.
Figure 4:
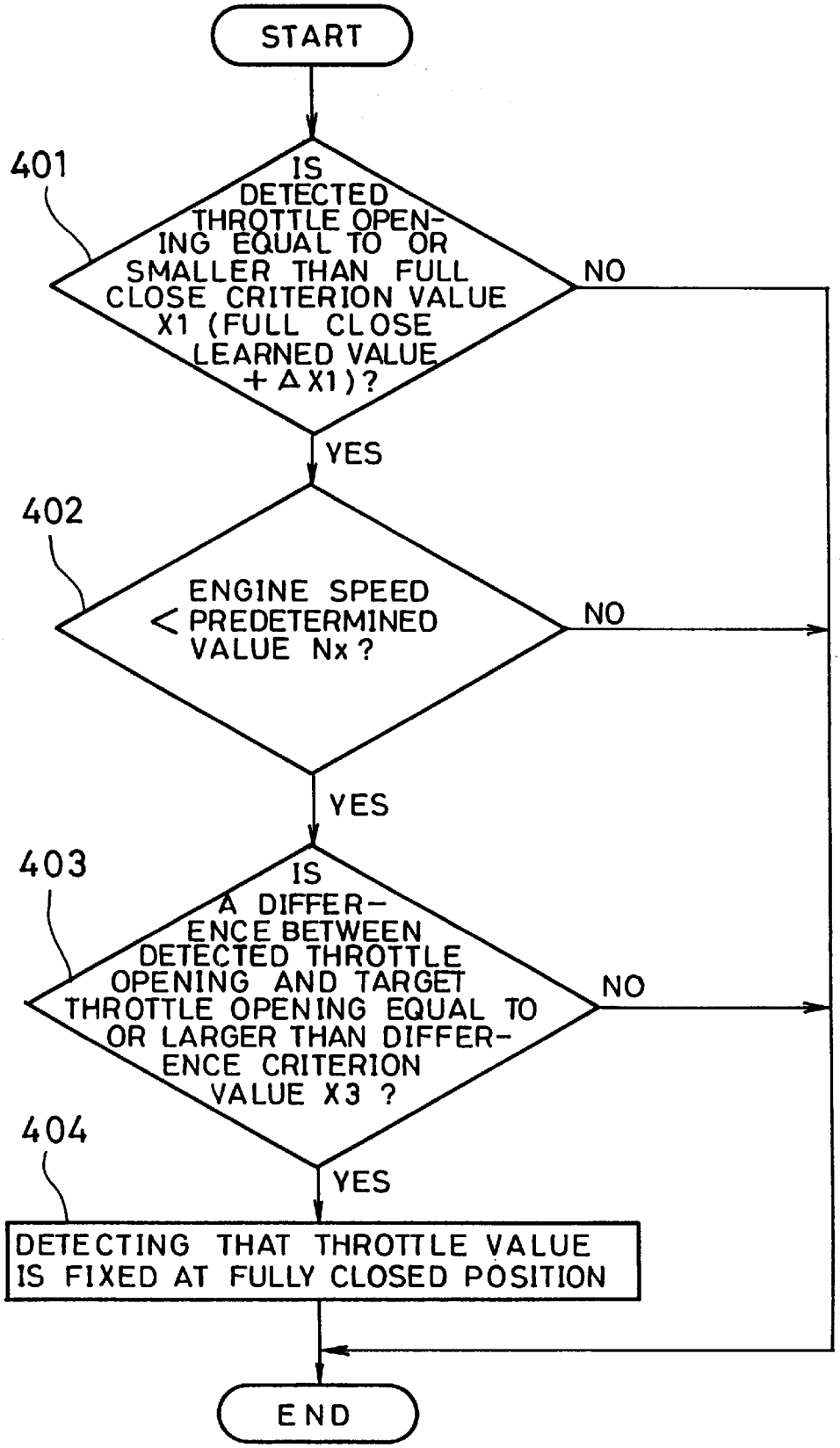
FIG. 4 is a flow chart illustrating the determination process on fixation in Embodiment 2 of the present invention.

FIG. 3 shows a whole throttle controller according to Embodiment 2 of the present invention, and FIG. 4 is a flow chart illustrating the determination process on whether a throttle valve is fixed at a fully closed position in Embodiment 2.

As shown in FIG. 3, in this Embodiment 2, an engine stable operation judging means 22 is provided in the valve fixation judging means 14 in place of the valve moving amount judging means 16 of Embodiment 1. The engine stable operation judging means 22 determines whether the engine speed is larger than a stable operation criterion value Nx and whether an engine stall occurs in the engine 4 by judging whether an engine speed from the engine speed sensor 5 is equal to or larger than the stable operation criterion value Nx preset in the engine stable operation judging means 22 as a constant value.

In Embodiment 1, when a change in a detected throttle opening per a predetermined time Tmsec is equal to or smaller than the movement criterion value X2 in the step 202, it is concluded that the movement of the throttle valve 8 is small. When the difference between the detected throttle opening and the target throttle opening is small, the movement of the throttle valve 8 is substantially small. Therefore, if the target throttle opening is set in the vicinity of the fully closed position and the movement of the throttle valve 8 is substantially small, it may be erroneously concluded that the throttle valve 8 is fixed at the fully closed position.

To solve this problem, it is noted that when the engine speed is larger than the stable operation criterion value Nx and an engine stall has not occurred, it is not necessary to determine whether the throttle valve is fixed at the fully closed position. Therefore, in Embodiment 2, as shown in step 402 of FIG. 4, when the engine speed is larger than the stable operation criterion value Nx, determination on whether the throttle valve 8 is fixed at the fully closed position is eliminated, thereby preventing the erroneous conclusion that the throttle valve 8 is fixed at the fully closed position.

Embodiment 3

Figure 5:
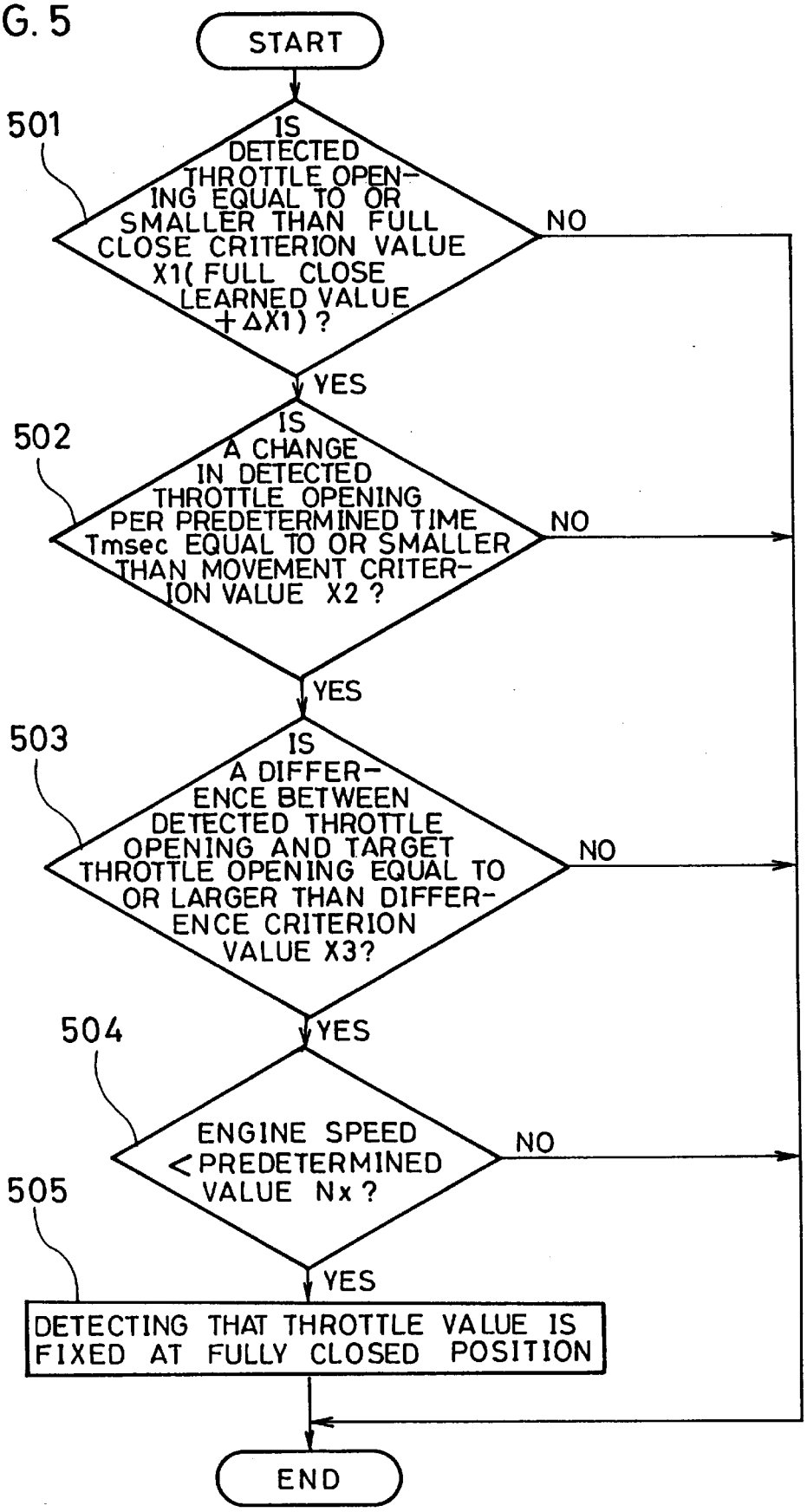
FIG. 5 is a flow chart illustrating the determination process on fixation in Embodiment 3 of the present invention.
Figure 6:
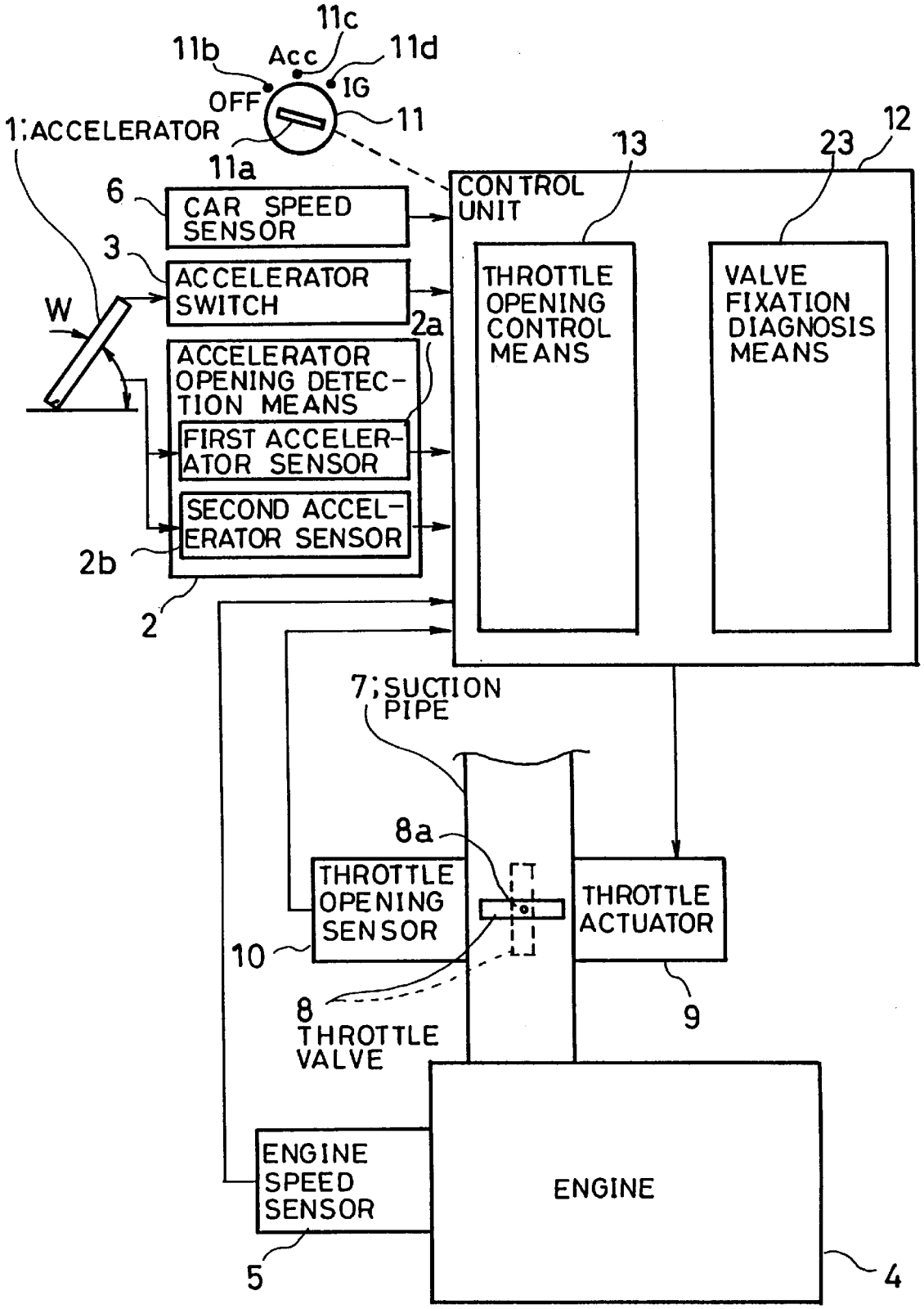
FIG. 6 PRIOR ART
FIG. 6 is a structural diagram of a car throttle controller of the prior art.

FIG. 5 is a flow chart illustrating the determination process on whether a throttle valve is fixed at the fully closed position according to Embodiment 3 of the present invention. Embodiment 3 is a combination of Embodiment 1 and Embodiment 2. That is, whether the movement of the throttle valve 8 is small is determined in step 502, and whether the engine speed is equal to or larger than the stable operation criterion value Nx is determined in step 504. Therefore, only when the engine speed is smaller than the stable operation criterion value Nx, is it concluded that the throttle valve 8 is fixed at the fully closed position, thereby increasing the detection accuracy of the throttle valve 8 being fixed at the fully closed position and preventing the erroneous conclusion that the throttle valve 8 is fixed at the fully closed position.

In Embodiment 3, though a structural diagram thereof is omitted, the engine stable operation judging means 22 of FIG. 3 is added to the valve fixation diagnosis means 14 of FIG. 1.

According to the first aspect of the present invention, when three judging conditions are established: 1) the throttle valve is located at a fully closed position or in the vicinity thereof, 2) the movement of the throttle valve is small, and 3) the opening of the throttle valve is different from the target throttle opening, it is concluded that the throttle valve is fixed at the fully closed position. Therefore, the detection accuracy of the throttle valve being fixed at the fully closed position is improved as compared with the case where it is concluded that the throttle valve is fixed at the fully closed position based on a single judging condition that the detected throttle opening is equal to or smaller than a criterion value corresponding to the fully closed position of the throttle valve.

According to the second aspect of the present invention, when three judging are established: 1) that the throttle valve is located at a fully closed position or in the vicinity thereof, 2) the engine speed is so unstable that an engine stall can occur, and 3) the opening of the throttle valve is different from the target throttle opening, it is concluded that the throttle valve is fixed at a fully closed position. Therefore, the detection accuracy of the throttle valve being fixed at the fully closed position is improved as compared with the case where it is concluded that the throttle valve is fixed at the fully closed position based on a single judging condition that the detected throttle opening is equal to or smaller than a criterion value corresponding to the fully closed position of the throttle valve. In other words, when the engine speed is larger than a stable operation criterion value and an engine stall does not occur, it is not necessary to consider whether the throttle valve is fixed at the fully closed position. Therefore, when the engine speed is larger than the stable operation criterion value, determination of whether the throttle valve is fixed at the fully closed position is eliminated, thereby preventing the erroneous conclusion that the throttle valve is fixed at the fully closed position.

According to the third aspect of the present invention, when four judging conditions are established: 1) the throttle valve is located at a fully closed position or in the vicinity thereof, 2) the movement of the throttle valve is small, 3) the engine speed is so unstable that an engine stall can occur, and 4) the opening of the throttle valve is different from the target throttle opening, it is concluded that the throttle valve is fixed at a fully closed position. Therefore, the detection accuracy of the throttle valve being fixed at the fully closed position is improved as compared with the case where it is concluded that the throttle valve is fixed at the fully closed position based on a single judging condition that the detected throttle opening is equal to or smaller than a criterion value corresponding to the fully closed position of the throttle valve. In other words, it is concluded that the throttle valve is fixed at the fully closed position only when the throttle valve is located at the fully closed position or in the vicinity thereof, the movement of the throttle valve is small, the opening of the throttle valve is different from the target throttle opening, and the engine speed is smaller than the stable operation reference value, thereby increasing the detection accuracy of the throttle valve being fixed at the fully closed position and preventing the erroneous conclusion that the throttle valve is fixed at the fully closed position.

According to the fourth aspect of the present invention, since a fully closed learned value is used as the fully closed criterion value, it is possible to determine the fixation of the throttle valve including the case where the actual throttle valve is fully closed.

According to the fifth aspect of the present invention, since the sum of the fully closed learned value and a constant value is used as the fully closed criterion value, it is possible to determine the fixation of the throttle valve including the case where the actual throttle valve is fully closed.

According to the sixth aspect of the present invention, since the bypass pipe is opened by opening the emergency valve when it is detected that the throttle valve is fixed at the fully closed position, clean air is sucked from the suction pipe to the engine through the bypass pipe bypassing the throttle valve, thereby preventing the occurrence of an engine stall and shifting the automobile from normal driving to emergency driving.

According to the seventh aspect of the present invention, since a malfunction alarm means informs a driver that the throttle valve is fixed at the fully closed position, when it is detected that the throttle valve is fixed at the fully closed position, the driver can properly carry out a shift operation from normal driving to emergency driving.

What is claimed is:

1. A car throttle controller is provided which comprises: a throttle opening control means for adjusting the volume of intake air for an engine by controlling electrically the opening of a throttle valve to a target throttle opening based on a difference between the target throttle opening, calculated from data including the operation amount of an accelerator, and a throttle opening detected by a throttle valve opening detection means for detecting the opening of the throttle valves; and a valve fixation diagnosis means for determining electrically whether the throttle valve is fixed at a fully closed position at which the volume of intake air for the engine is reduced to such an extent that an engine stall occurs, wherein the valve fixation diagnosis means comprises:

a fully closed valve judging means for determining whether the detected throttle opening is equal to or smaller than a fully closed criterion value;

a valve moving amount detection means for determining whether a change in a detected throttle opening per a predetermined time is equal to or smaller than a movement criterion value;

an opening difference judging means for determining whether a difference between the detected throttle opening and the target throttle opening is equal to or larger than a difference criterion value; and a valve malfunction detection means for concluding that the throttle valve is fixed at a fully closed position and outputting a malfunction signal when the fully closed valve judging means determines that the detected throttle opening is equal to or smaller than the fully closed criterion value, the valve moving amount judging means determines that a change in a detected throttle opening per a predetermined time is equal to or smaller than the movement criterion value, and the opening difference judging means determines that the difference between the detected throttle opening and the target throttle opening is equal to or larger than the difference criterion value.

2. A car throttle controller is provided which comprises: a throttle opening control means for adjusting the volume of intake air for an engine by controlling electrically the opening of a throttle valve to a target throttle opening based on a difference between the target throttle opening, calculated from data including the operation amount of an accelerator, and a throttle opening detected by throttle valve opening detection means for detecting the opening of the throttle valve; and a valve fixation diagnosis means for determining electrically whether the throttle valve is fixed at a fully closed position at which the volume of intake air for the engine is reduced to such an extent that an engine stall occurs, wherein the valve fixation diagnosis means comprises:

a fully closed valve judging means for determining whether the detected throttle opening is equal to or smaller than a fully closed criterion value;

engine stable operation judging means for determining whether an engine speed is equal to or smaller than a stable operation criterion value;

an opening difference judging means for determining whether a difference between the detected throttle opening and the target throttle opening is equal to or larger than a difference criterion value; and a valve malfunction detection means for concluding that the throttle valve is fixed at a fully closed position and outputting a malfunction signal when the fully closed valve judging means determines that the detected throttle opening is equal to or smaller than the fully closed criterion value, the engine stable operation judging means determines that the engine speed is equal to or smaller than the stable operation criterion value, and the opening difference judging means determines that the difference between the detected throttle opening and the target throttle opening is equal to or larger than the difference criterion value.

3. A car throttle controller is provided which comprises: a throttle opening control means for adjusting the volume of intake air for an engine by controlling electrically the opening of a throttle valve to a target throttle opening based on a difference between the target throttle opening calculated from data including the operation amount of an accelerator, and a throttle opening detected by throttle valve opening detection means for detecting the opening of the throttle valve; a and valve fixation diagnosis means for determining electrically whether the throttle valve is fixed at a fully closed position at which the volume of intake air for the engine is reduced to such an extent that an engine stall occurs, wherein the valve fixation diagnosis means comprises:

a fully closed valve judging means for determining whether the detected throttle opening is equal to or smaller than a fully closed criterion value;

a valve moving amount detection means for determining whether a change in a detected throttle opening per a predetermined time is equal to or smaller than a movement criterion value;

an opening difference judging means for determining whether a difference between the detected throttle opening and the target throttle opening is equal to or larger than a difference criterion value;

an engine stable operation judging means for determining whether an engine speed is equal to or smaller than a stable operation criterion value; and a valve malfunction detection means for concluding that the throttle valve is fixed at a fully closed position and outputting a malfunction signal when the fully closed valve judging means determines that the detected throttle opening is equal to or smaller than the fully closed criterion value, the valve moving amount judging means determines that a change in a detected throttle opening per a predetermined time is equal to or smaller than the movement criterion value, the opening difference judging means determines that the difference between the detected throttle opening and the target throttle opening is equal to or larger than the difference criterion value, and the engine stable operation judging means determines that the engine speed is equal to or smaller than the stable operation criterion value.

4. The car throttle controller of claim 1, wherein a fully closed learned value which stores a throttle opening detected before the engine is started and without the operation of the accelerator is used as the fully closed criterion value.

5. The car throttle controller of claim 1, wherein the sum of a fully closed learned value which stores a throttle opening detected before the engine is started and without the operation of the accelerator and a preset constant value is used as the full close criterion value.

6. The car throttle controller of claim 1, wherein a bypass pipe, bypassing the throttle valve, for introducing air to the engine is provided in a suction pipe around the throttle valve, and an emergency valve for closing the bypass pipe is provided in the bypass pipe and is opened in response to a malfunction signal from the valve malfunction detection means to open the bypass pipe.

7. The car throttle controller of claim 1 which further comprises a malfunction alarm means for informing a driver that the throttle valve is fixed at a fully closed position in response to a malfunction signal from the valve malfunction detection means.

* * * * *